US006755506B2

(12) United States Patent
Nishikori et al.

(10) Patent No.: US 6,755,506 B2
(45) Date of Patent: Jun. 29, 2004

(54) INK JET PRINT HEAD AND INK JET PRINTING APPARATUS

(75) Inventors: Hitoshi Nishikori, Tokyo (JP); Naoji Otsuka, Kanagawa (JP); Kiichiro Takahashi, Kanagawa (JP); Osamu Iwasaki, Tokyo (JP); Minoru Teshigawara, Kanagawa (JP); Takeshi Yazawa, Kanagawa (JP); Toshiyuki Chikuma, Kanagawa (JP); Satoshi Seki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/395,175

(22) Filed: Mar. 25, 2003

(65) Prior Publication Data

US 2003/0179262 A1 Sep. 25, 2003

(30) Foreign Application Priority Data

Mar. 25, 2002 (JP) ..... 2002-084407

(51) Int. Cl.[7] ..... B41J 2/145; B41J 2/15

(52) U.S. Cl. ..... 347/40

(58) Field of Search ..... 347/40, 43, 16, 347/41

(56) References Cited

U.S. PATENT DOCUMENTS

| | | | | |
|---|---|---|---|---|
| 4,215,350 A | * | 7/1980 | Mielke et al. | 347/12 |
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,608,577 A | | 8/1986 | Hori | |
| 4,723,129 A | | 2/1988 | Endo et al. | |
| 4,740,796 A | | 4/1988 | Endo et al. | |
| 5,691,760 A | * | 11/1997 | Hosier et al. | 347/238 |
| 6,033,055 A | | 3/2000 | Nagoshi et al. | |
| 6,086,180 A | | 7/2000 | Sugimoto et al. | |
| 6,123,411 A | | 9/2000 | Inui et al. | |
| 6,394,579 B1 | * | 5/2002 | Boyd et al. | 347/47 |
| 2002/0008729 A1 | | 1/2002 | Kaneko et al. | |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |

* cited by examiner

*Primary Examiner*—Thinh Nguyen
(74) *Attorney, Agent, or Firm*—Fitzpatrick, Cella, Harper & Scinto

(57) ABSTRACT

In an ink jet print head used in a serial type ink jet printing apparatus according the present invention, a portion of the nozzle column is given a wider nozzle-to-nozzle interval than those of other portions of the nozzle column so that the width in the line feed direction of each image area printed in a single printing scan by the ink jet print head is longer than a distance that a print medium is moved by one line feed. In this serial print head, the width of each image area printed by a single printing scan can be made a predetermined amount longer than the line feed distance at all times. As a result, the adjoining image areas printed by separate printing scans overlap each other at their boundary portions by a predetermined amount.

11 Claims, 8 Drawing Sheets

INK JET PRINT HEAD AND INK JET PRINTING APPARATUS

This application claims priority from Japanese Patent Application No. 2002-084407 filed Mar. 25, 2002, which is incorporated hereinto by reference.

BACKGROUND OF THE INVENTION

1. Field of the Invention

The present invention relates to an ink jet print head and an ink jet printing apparatus for ejecting ink onto a print medium to form an image thereon.

2. Description of the Related Art

An ink jet printing apparatus forms an image on a print medium by ejecting ink droplets from a print head mounted in an apparatus body onto the print medium, with the ink droplets adhering to the print medium and fixing in it to produce their intended colors. Recent years have seen a proliferation of a so-called serial scan type ink jet printing apparatus. In this type, an image is formed by alternately repeating two operations—a printing scan for scanning the print head over the print medium to eject ink onto the medium and a paper feed for moving the print medium or the print head relative to each other in a direction perpendicular to a printing scan direction. The serial scan type ink jet printing apparatus, however, has the following drawback.

In the serial scan type apparatus, a single printing scan can only produce an image of a predetermined printing width for at least one color of ink (this single printing operation is referred to also as a "one-pass printing"). Hence, to form an image over the entire print medium requires performing a plurality of printing scans. When in such a system an image of high duty is to be formed, a problem may occur that a boundary portion between an image area formed on the print medium in a certain printing scan and an adjoining image area formed in another printing scan appears light in density.

This problem is considered to occur in the following mechanism. FIGS. 7A to 7D are schematic views showing how an image of high duty is formed during the one-pass printing, as seen in the print head scanning direction. In the figure, reference number 1 represents a print head, 2 a print medium, and e a column of nozzles (also referred to as a "column of ejection openings") for ejecting ink droplets.

FIG. 7A shows ink droplets adhering to a print medium which were ejected in one printing scan. In the figure, p1 denotes an ink adhering to the print medium. With the elapse of time the ink on the print medium soaks into the medium and fixes there. FIG. 7B illustrates this state and p2 denotes the ink that has soaked into the print medium and fixed there. After the printing scan, the print medium is fed in a direction perpendicular to the printing scan direction of the print head (this operation is called a line feed) and the next printing scan is performed. FIG. 7C shows a state in which the line feed and the second printing scan have been performed. In the figure, a distance that the print medium was fed is indicated by an arrow. This line feed distance is equal to the length of the nozzle column of the print head. Ink droplets adhering to the print medium that were ejected in the second printing scan are indicated by p3.

FIG. 7D shows a state in which the ink that landed on the print medium during the second printing scan has soaked and fixed with elapse of time. As shown by p1 of FIG. 7A and p3 of FIG. 7C, the ink that has just landed on the print medium and has not yet soaked into and fixed in the print medium forms an ink surface that is low at ends and bulges at a center. This is a common phenomenon produced by a surface tension of the ink. In this state, the ink penetrates and fixes in the print medium. Therefore, as indicated by p2 and p4 of FIGS. 7B and 7D, in an image area formed by each printing scan, an amount of ink that fixes at the end portions is less than at other portions and the color of that portions tends to be lighter. Thus, when the printing scan is repeated a plurality of times to form an image of high duty, the end portions of an image area formed by each printing scan appear light. That is, the boundary portions between adjoining image areas are printed lighter than other portions, giving rise to a problem of light stripes showing up in the printed image. In the case of a black ink in particular, since its penetration capability is generally low, it tends to produce a greater density difference between a dot center and a dot end than do color inks. This may result in boundary portions between adjoining image areas printed by different printing scans appearing lighter and in the worst case showing up as white horizontal stripes.

A possible measure to deal with this problem may involve making the line feed distance shorter than the printing width or nozzle column length of the print head. One such example is to design a nozzle-to-nozzle interval (nozzles may also be referred to as "ejection openings") somewhat longer than normal. As a result, the length of the nozzle column used for the one-pass printing becomes somewhat longer than the line feed distance, producing the following advantages.

FIGS. 8A to 8D show dots ejected from a nozzle column with a longer-than-normal nozzle-to-nozzle interval. In the figure, reference numeral 1 represents a print head, 2 a print medium and e a nozzle column for ejecting ink droplets. FIG. 8A shows ink droplets adhering to the print medium which were ejected in one printing scan. In the figure, p1 denotes an ink adhering to the print medium. With the elapse of time the ink on the print medium soaks into the print medium and fixes there. FIG. 8B illustrates this state and p2 denotes the ink that has soaked into the print medium and fixed there. After the first printing scan, the print medium is fed (line feed) in a direction perpendicular to the printing scan direction of the print head and the next printing scan is performed. Because the nozzle-to-nozzle interval of the print head is set somewhat longer than normal, the line feed distance is shorter than the nozzle column length e. FIG. 8C shows a state in which the line feed and the second printing scan have been performed. In the figure, a distance that the print medium was fed is indicated by an arrow and, as described above, is somewhat shorter than the nozzle column length e of the print head. Ink droplets adhering to the print medium that were ejected in the second printing scan are indicated by p3. Then, the ink that landed on the print medium during the second printing scan also sinks and fixes in the print medium over time, as shown in FIG. 8D.

Since the line feed distance shown in FIG. 7C is equal to the nozzle column length or a difference between the line feed distance and the nozzle column length is smaller than that of FIG. 8C, a comparison between FIG. 8D and FIG. 7D shows that an overlap between p2 and p4 is somewhat larger in FIG. 8D than in FIG. 7D. Thus, as shown in FIG. 8D, the above-described problem that a boundary portion between an image area formed on the print medium by a printing scan and an adjoining image area formed by another printing scan appears lighter than other portions is less likely to occur.

Printing apparatus capable of printing color inks as well as black ink are available in recent years. Some of these printing apparatus have a black ink nozzle column set longer than other color ink nozzle columns in order to reduce a time taken by the printing operation using only the black ink as in a document printing. In this arrangement, when printing is done using only the black ink, all the nozzles of the black ink nozzle column are used, whereas during color printing, only that part of the black ink nozzle column which is almost equal in length to other color ink nozzle columns is used. In such a printing apparatus, in which the length of that nozzle portion in the entire nozzle column which is used for printing is changed according to an image being formed, a problem may arise that lighter horizontal stripes will show up in a printed image at boundaries between adjoining image areas formed on a print medium by separate printing scans, depending on the length of the nozzle portion used for printing. This problem will be explained as follows.

Referring to FIG. 2 and FIG. 3, reference number 1 denotes a print head, 3 a nozzle column for ejecting a black ink, and 4 nozzle columns for ejecting color inks. To solve the problem described above, the black ink nozzle column is formed longer than the color ink nozzle columns. In the black nozzle column 3, the entire nozzles are represented as a nozzle portion e and a part of the nozzle column is denoted a nozzle portion b. The nozzle portion b has one-half the length of the nozzle portion e. The entire nozzles arrayed in each of the color ink nozzle columns are represented as a nozzle portion a. The number of nozzles in the nozzle portion a counted in the column direction is equal to that of the nozzle portion b.

FIG. 2 is a schematic view showing an operation of the printing apparatus when an image is formed using only a black ink. When an image is formed using only the black ink, the whole black nozzle column (nozzle portion e) is used as described above. In the figure, (f1)-p1 represents a position relative to the print head of an image formed with the black ink in one printing scan. This is followed by a line feed of a predetermined distance in a direction indicated by LF. The line feed distance is shorter than the length of the nozzle portion e. The printed image p1 moves to a position (f2)-p1. After this, another printing scan is performed to form an image (f2)-p2.

FIG. 3 is a schematic view showing an operation of the printing apparatus when an image is formed using a black ink and color inks. As described above, when an image is formed using color inks as well as a black ink, the nozzle portion b of the black nozzle column and the nozzle portion a of the color nozzle columns are used. In the figure, (f1)-p1 represents a position relative to the print head of an image formed with the black ink in one printing scan. After this, a line feed of a predetermined distance is carried out in the direction of LF, moving the printed image p1 to a position (f2)-p1. This is followed by another printing scan to form an image at a position (f2)-p1 using color inks and an image at a position (f2)-p2 using a black ink. As a result, in the (f2)-p1 area the image forming using the black ink and the color inks is completed.

Whether an image is to be made using only a black ink or both a black ink and color inks is determined based on image data sent from a host computer. A printer driver running on the host computer displays an operation window for the user to select either a color printing or a black-only printing. When the user makes a selection on the operation window, the printer driver sends a color printing instruction or a black-only printing instruction along with image data to the printing apparatus. The printing apparatus determines the operations of various driving units according to the instruction received. Another arrangement is also available in which, rather than the user selecting either a color printing or a black-only printing, the printing apparatus checks the image data transferred from the host to make a decision. Still another arrangement is available in which a detailed control is performed to switch the black nozzle operation between a long nozzle portion and a short nozzle portion of the black nozzle column according to the image data in each page. That is, in an area of each page to be printed with only a black ink a long black nozzle portion, i.e., entire black nozzle column, is used and, in an area to be printed with color inks as well, a short black nozzle portion equal in length to the color nozzle columns is used.

In a printing apparatus with a means to change the length of a black nozzle portion to be used for printing, it has been proposed to set a nozzle interval a predetermined amount longer than normal to deal with the aforementioned problem of light density portions showing up in a printed image at boundaries between image areas printed by separate printing scans. As explained earlier in conjunction with FIG. 2 and FIG. 3, the length of an activated portion of the black nozzle column differs between the black-only printing and the color printing. Therefore, the difference between the line feed distance and the width (in the line feed direction) of a black printed area also varies. More specifically, the black nozzle column is set somewhat longer than normal by expanding the nozzle intervals uniformly. If it is assumed that the black nozzle column is set longer by t than the normal nozzle column length s, an entire length of the nozzle column is s+t. In a black-only printing, the entire black nozzle column is used and, if the line feed distance is assumed to be s, image areas printed by separate printing scans overlap each other over a distance of t. In a color printing, only the nozzle portion b of the black nozzle column is used, that is, only one-half of the black nozzle column is used. Then, the length of the nozzle portion b is $1/2 \cdot (s+t)$. Suppose that the line feed distance is s/2. The difference between the line feed distance and the length of the nozzle portion b is only t/2. Thus the overlap between the image areas is only t/2. This means that, if the nozzle interval is expanded to ensure an enough overlap during the black-only printing, the color printing cannot secure a sufficient overlap. Conversely, if the nozzle interval is set so as to cause a sufficient overlapping during the color printing, the amount of overlap at the boundary portions between separate printing scans becomes too large, giving rise to a problem that the overlapped portions may look darker than other portions.

SUMMARY OF THE INVENTION

In light of the conventional problems described above, it is an object of the present invention to provide an ink jet print head and an ink jet printing apparatus which can produce a good printed result at all times at boundary portions between image areas printed by separate printing scans even in ink jet printing apparatus in which a range of use of the nozzle column varies according to the printing condition.

In one aspect, the present invention provides an ink jet print head having a plurality of nozzles arrayed in a predetermined direction to form a nozzle column, wherein the nozzle column ejects ink droplets, the ink jet print head comprising: a long nozzle column portion formed in a predetermined portion of the nozzle column, the long nozzle column portion having a wider nozzle interval than those in other portions of the nozzle column.

In another aspect, the present invention provides an ink jet printing apparatus comprising: a ink jet print head having a plurality of nozzles arrayed in a predetermined direction to form a nozzle column, the nozzle column being adapted to eject ink droplets; wherein the ink jet print head is scanned over a print medium a plurality of times in a direction different from the direction of array and a printing scan and a line feed are performed to print on a predetermined image area on the print medium, the printing scan ejecting ink droplets onto the print medium during each scan and the line feed feeding, between each of the plurality of scans, the print medium and the ink jet print head relative to each other in a direction different from the scan direction of the ink jet print head; wherein a portion of the nozzle column in the ink jet print head is a long nozzle column portion whose nozzle-to-nozzle interval is wider than that in another portion of the nozzle column; wherein a width in the line feed direction of each image area printed by a single printing scan of the ink jet print head is longer than a distance that the print medium is fed by one print feed.

With this construction, by arranging the nozzles in the nozzle column such that, in only that portion of the nozzle column always used in any printing condition, such as color printing and black-only printing, its nozzles have a wider nozzle-to-nozzle interval than those of other nozzle portions, the width of each image area printed by a single printing scan can be made a predetermined amount longer than the line feed distance at all times. This arrangement can produce a printed result in which adjoining image areas printed by separate printing scans overlap each other at their boundary portions by a predetermined amount in whatever printing condition.

The above and other objects, effects, features and advantages of the present invention will become more apparent from the following description of embodiments thereof taken in conjunction with the accompanying drawings.

DETAILED DESCRIPTION OF PREFERRED EMBODIMENTS

In a nozzle column whose activated range of nozzles is changed according to the condition of printing, this invention, rather than making all nozzle intervals equal, sets somewhat longer than normal nozzle intervals in a nozzle portion that is used by a printing scan when the width of an area to be printed is relatively short and somewhat shorter than normal nozzle intervals in the remaining nozzle portion. This enables printing to be performed under the condition that the nozzle portion used by the printing scans, whether it is the entire nozzle column or the relatively short nozzle portion, is always longer than the line feed distance, thereby solving the aforementioned problem that boundary portions between adjoining image areas formed by different printing scans may look lighter.

(Embodiment 1)

Figure 1:
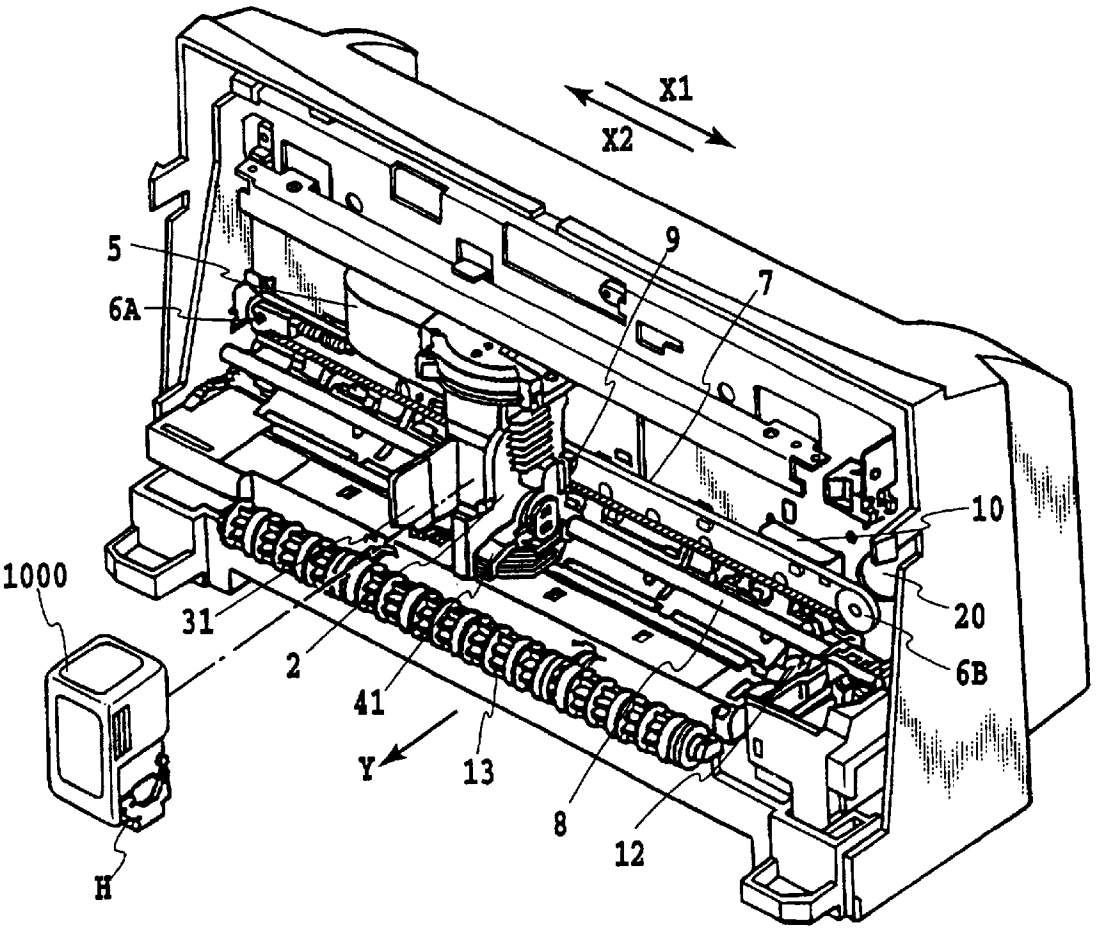
FIG. 1 is a perspective view showing an ink jet printing apparatus as one embodiment of the present invention.

FIG. 1 is a perspective view showing an outline construction of an ink jet printing apparatus to which the present invention can be applied. In FIG. 1, denoted 1000 is a replaceable ink jet cartridge which has an ink jet print head H capable of ejecting ink droplets and ink tanks connected to the print head to supply inks to the print head. Reference number 2 represents a carriage unit capable of mounting the ink jet cartridge 1000 and which is guided along a guide shaft 8 so that it can be moved in a main scan direction indicated by arrows X1, X2. The carriage unit 2 is connected to a belt 7 wound around pulleys 6A, 6B and is moved in the main scan direction by a drive force of a carriage motor 20 that is transmitted through the belt 7. The cartridge 1000 is positioned and secured in a holder 31 of the carriage unit 2 by an action of a fixing lever 41. When the cartridge 1000 is positioned and fixed, an electric contact on the side of the cartridge 1000 comes into engagement with an electric contact on the side of the carriage unit 2. Denoted 5 is a flexible cable for transmitting a signal from a control unit to the cartridge 1000. A transmission type photocoupler 9 attached to the carriage unit 2 and a light shielding plate 10 mounted to the apparatus body combine to detect when the carriage unit 2 has moved to a predetermined home position. A home position unit 12 installed at the home position has a recovery system which comprises a cap member capable of capping a nozzle opening surface of the print head H, a suction means for sucking out ink from the cap member, and a wipe member for wiping the nozzle opening surface. A discharge roller 13 in combination with a spur roller not shown holds the printed medium between them and discharges it outside the apparatus body. These rollers along with a line feed unit including paper feed rollers and pinch rollers make up a transport means for moving the printed medium in a subscan direction indicated by an arrow Y.

Figure 2:
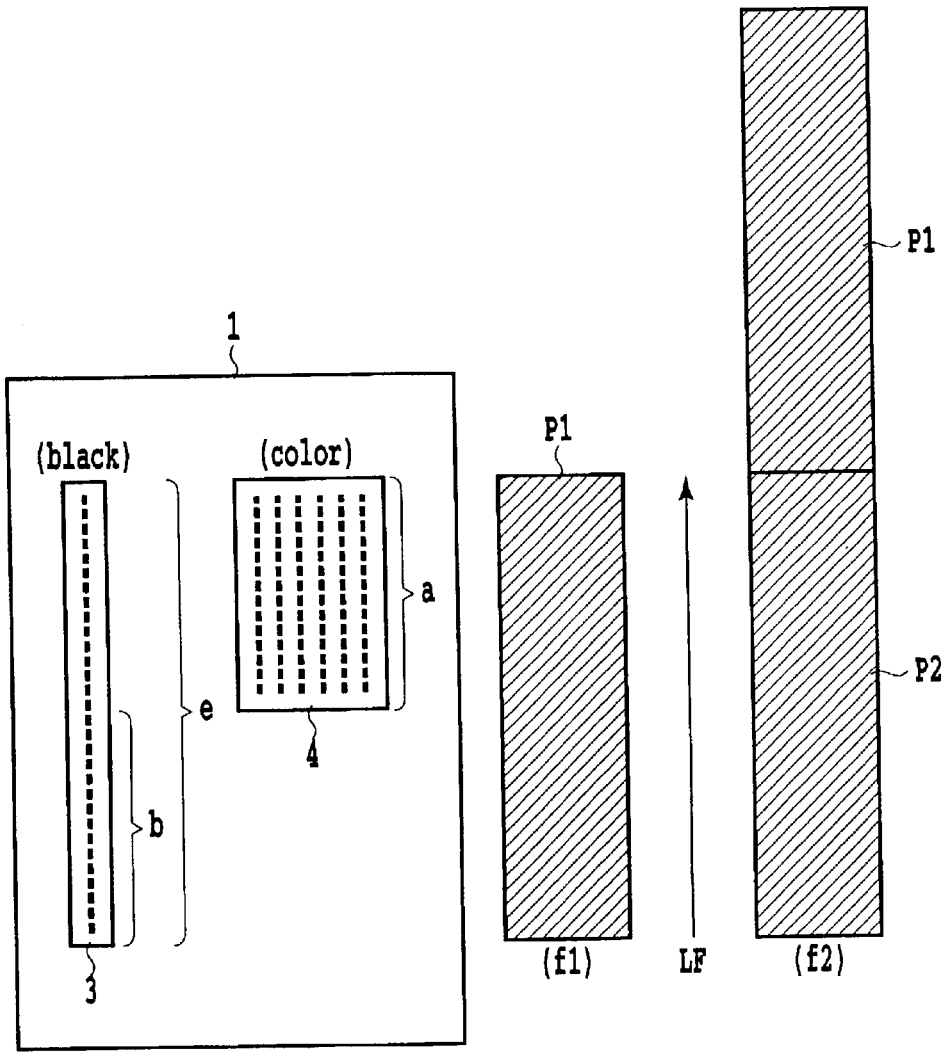
FIG. 2 is a schematic diagram showing how a black-only printing is performed with a print head that uses different ranges of nozzles in a black nozzle column for a black-only printing and a color printing.
Figure 3:
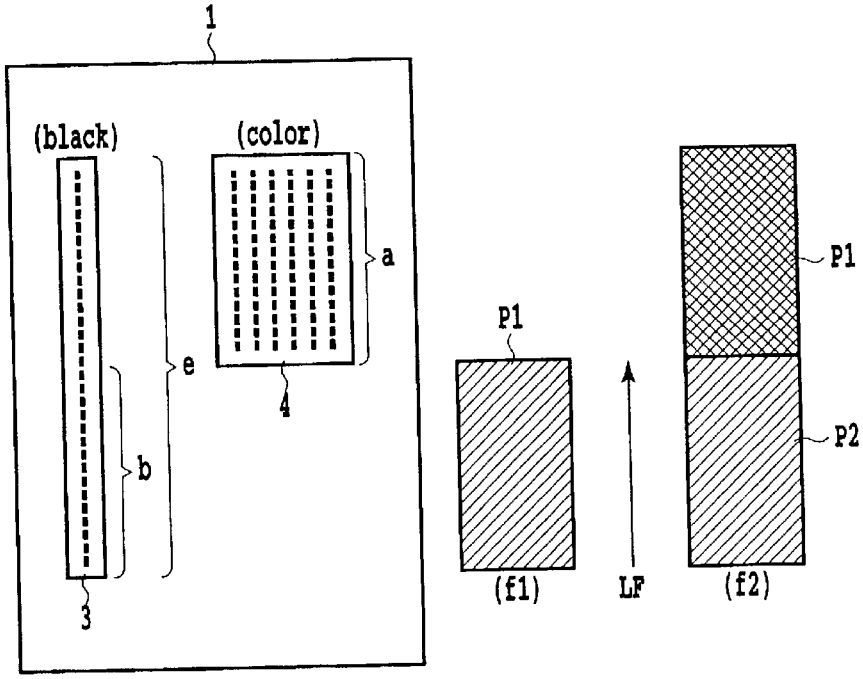
FIG. 3 is a schematic diagram showing a color printing operation using the print head of FIG. 2.

The outline construction of the print head is similar to that shown in FIG. 2 and FIG. 3. In the print head of this embodiment, a heater as an electrothermal transducer is provided for each nozzle. In ejecting ink, this heater is energized to generate a bubble in ink to expel an ink droplet of a predetermined volume by a pressure of the bubble as it grows. The print head of this invention may employ the bubble-through system described above or any other system such as a piezoelectric system.

The way the black ink nozzle column is used is similar to that explained earlier in connection with FIG. 2 and FIG. 3 for both of the printing using only a black ink and the printing using color inks as well as the black ink. That is, during the black-only printing the entire nozzle column is used and, during the color printing, only a part of the nozzle column is used.

While in the conventional black ink nozzle column the nozzle intervals are set equal over the entire length of the column, the nozzle column of this invention does not make the nozzle intervals uniform but differentiates nozzle intervals in one part of the nozzle column from those in another part, thereby resolving the problem experienced with the conventional nozzle column. The nozzle column of this embodiment will be detailed as follows.

Figure 4:
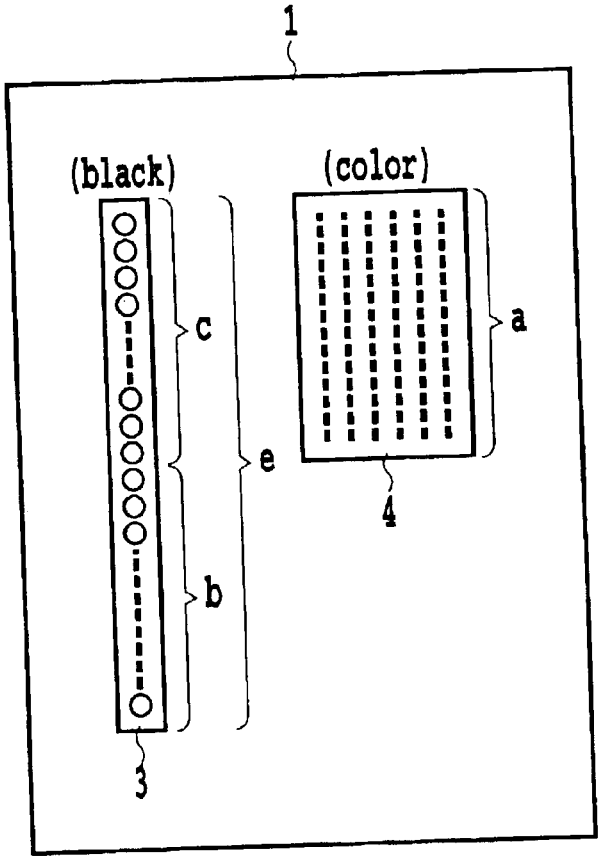
FIG. 4 is a schematic diagram showing a black ink nozzle column and color ink nozzle columns in a print head of a first embodiment.

FIG. 4 is a schematic diagram showing a black ink nozzle column and color ink nozzle columns in the print head of this embodiment. In the black ink nozzle column 3, an array of all nozzles is taken as a nozzle portion e, which is divided into a nozzle portion b and a nozzle portion c. Nozzle columns 4 of different color inks, for example yellow, magenta and cyan, are arranged parallel to the black nozzle column 3. As explained earlier, when an image is formed on a print medium with only a black ink, the entire nozzle column as indicated at 3, i.e., a nozzle portion represented by the range e, is used. When an image is formed using color inks in addition to the black ink, a nozzle portion b of the black nozzle column and the color nozzle columns are used. Subtracting the nozzle portion b from the entire black nozzle column leaves a nozzle portion c.

Here, a nozzle interval between each nozzle arrayed in the nozzle portion b is set wider than that of the nozzle portion c. That is, a nozzle-to-nozzle distance in the nozzle portion b is set larger than that of the nozzle portion c. More specifically, in the printing apparatus of this embodiment, black image data is processed at a resolution of 600 dpi (600 dots per inch) in the line feed direction. Of the black nozzle column shown at 3 in FIG. 4, the nozzle portion c is arranged at a nozzle interval of 600 dpi. That is, nozzles are formed at an interval of about 42.333 micrometers. In the nozzle portion b, the nozzles are formed at such an interval that the nozzle portion b is about 15 micrometers longer than when the nozzles are arranged at the same interval as used in the nozzle portion c, i.e., at the interval of 600 dpi. Hence, in the nozzle portion e the ratio in length of the nozzle portion b to the nozzle portion c is not 1:1 but the nozzle portion b is 15 micrometers longer than the nozzle portion c. In this embodiment, the black nozzle column has 600 nozzles and the nozzle portion c and the nozzle portion b have 300 nozzles each. The nozzle portion b therefore is designed to have a nozzle interval of about 42.383 micrometers. In the color nozzle columns shown at 4 in FIG. 4, the nozzle portion a has 300 nozzles at the interval of 600 dpi.

Figure 7A:
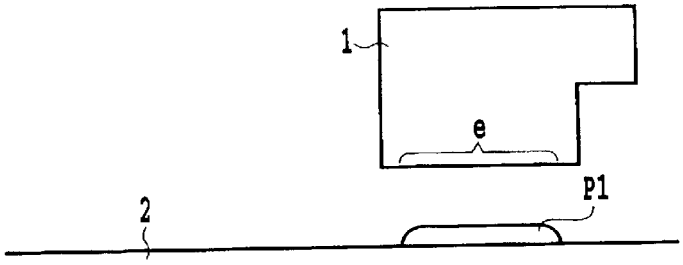
FIG.7A PRIOR ART
FIGS. 7A to 7D are schematic diagrams showing a relation between each of image areas printed by a conventional print head and a line feed distance.
Figure 7B:
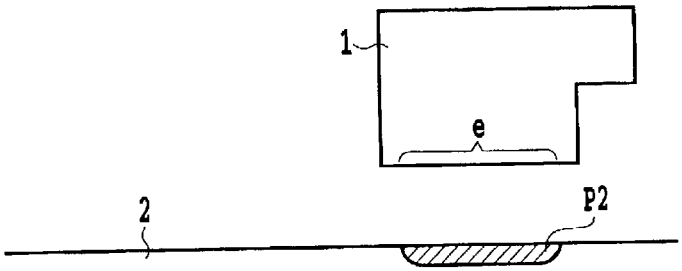
FIG.7B PRIOR ART
Figure 7C:
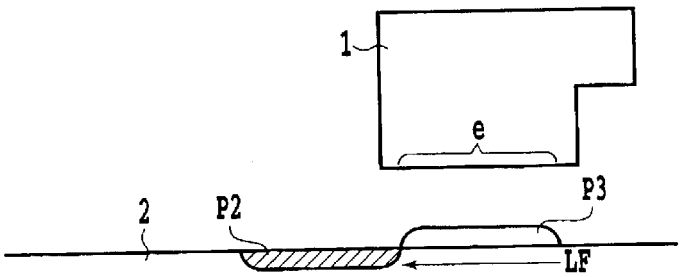
FIG.7C PRIOR ART
Figure 7D:
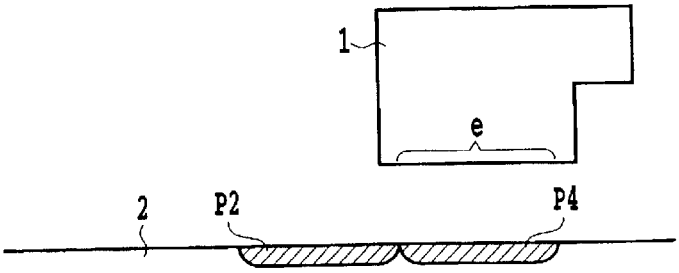
FIG.7D PRIOR ART
Figure 8A:
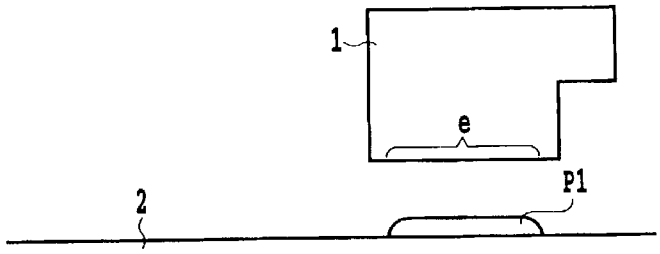
FIGS. 8A to 8D are schematic diagrams showing a case where each of image areas printed by the print head is larger than the line feed distance.
Figure 8B:
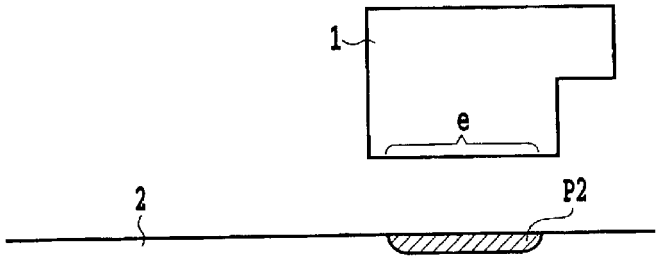
Figure 8C:
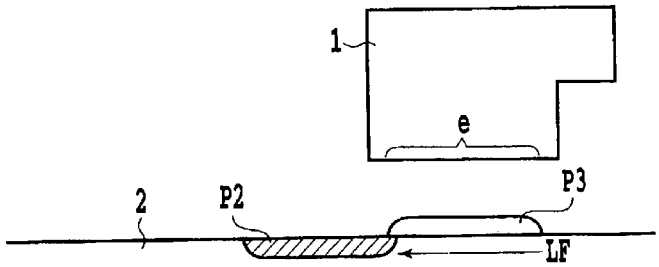
Figure 8D:
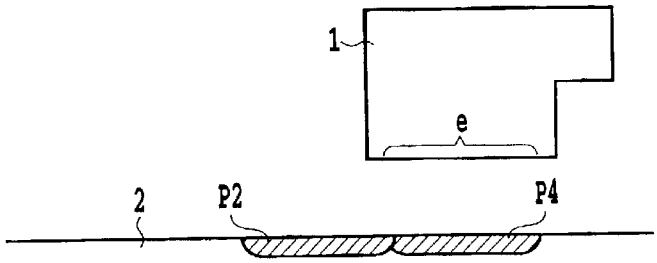

Since the nozzle portion b is longer than other nozzle portions as described above, the relation between the line feed distance and the printing width in the line feed direction of a printed area during a printing operation is as follows. During the color printing, the line feed distance is equal to a length of 300 nozzles arranged at the interval of 600 dpi (i.e., the length of the nozzle portion a in the color nozzle columns 4) or about 12.700 millimeters. The width in the line feed direction of a black image formed by one printing scan is about 12.715 millimeters, 15 micrometers longer than the line feed distance, because the nozzle interval is so set as to make the nozzle portion b 15 micrometers longer than when the nozzles are arranged at the interval of 600 dpi. Thus, the adjoining black image areas printed by separate printing scans overlap at their boundary portion by 15 micrometers. A black ink is slow in penetrating into a print medium compared with color inks and has a high surface tension. This means that the black ink easily forms an air-liquid interface on the surface of the print medium as shown at p3 in FIG. 7C and that an area inside the print medium in which the black ink spreads is relatively narrow. In contrast, color inks with high penetration capabilities spread relatively wide in the print medium. Therefore, if the width of a black image area printed in one printing scan is set equal to the widths of color image areas printed in one printing scan, it is feared that only the black image may look lighter at the boundary portions between adjoining image areas formed by a plurality of printing scans. However, in this embodiment, the nozzle interval setting is made such that the width of a black image area will be 15 micrometers longer than the widths of color image areas and the line feed distance is set so that only the black image areas overlap at the boundary portions, as described above. Thus, as explained with reference to FIGS. 8A to 8D, this embodiment can prevent the phenomenon in which the boundary portions between image areas printed by a plurality of printing scans appear lighter than other portions.

Further, during the black-only printing, an image is formed using the nozzle portion e of FIG. 4 or the entire black nozzle column. In this case, the line feed distance is equal to a length of 600 nozzles arranged at 600 dpi, or 25.400 millimeters. The width of a black image area formed by one printing scan is 25.415 millimeters, 15 micrometers longer than the line feed distance, because the nozzle portion b is set 15 micrometers longer than it would be if its nozzles were arranged at the interval of 600 dpi. Therefore, in the black-only printing, as in the color printing, the adjoining black image areas printed by different printing scans overlap each other by 15 micrometers at their boundary portions, preventing the phenomenon that the image appears light at the boundary portions between the image areas printed by a plurality of printing scans. Thus, a good printed result can be obtained.

In other words, since the overlapping amounts in the color printing and the black-only printing are equal, the printed results in both cases are satisfactory.

As described above, in the print head of this embodiment, that part of the black nozzle column which is used both in a black print mode using only the black nozzle column and in a color print mode using color nozzle columns as well as the black nozzle column (i.e., nozzle portion b) has its nozzle intervals set larger than in other portions. Printing with this print head can make the width of each black image area printed by a single printing scan a predetermined amount longer than the line feed distance in any of the print modes. Therefore, the amount of overlap at each boundary portion between the adjoining image areas printed by single printing scans can be made constant irrespective of the print mode. As a result, the image qualities at the boundary portions can be made equal in both print modes.

(Embodiment 2)

Ingredients of a black ink may be so set that fixing characteristics of black ink in a print medium, such as penetration speed and bleeding, differ from those of color inks such as cyan, magenta and yellow in order to produce a better result in printing documents. However, if during a color printing such a black ink is used in the same way as the color inks, a bleeding may result. In the following an embodiment will be described which can provide, in addition to the effects of Embodiment 1, a capability of preventing a possible bleeding of black and color inks.

Figure 5:
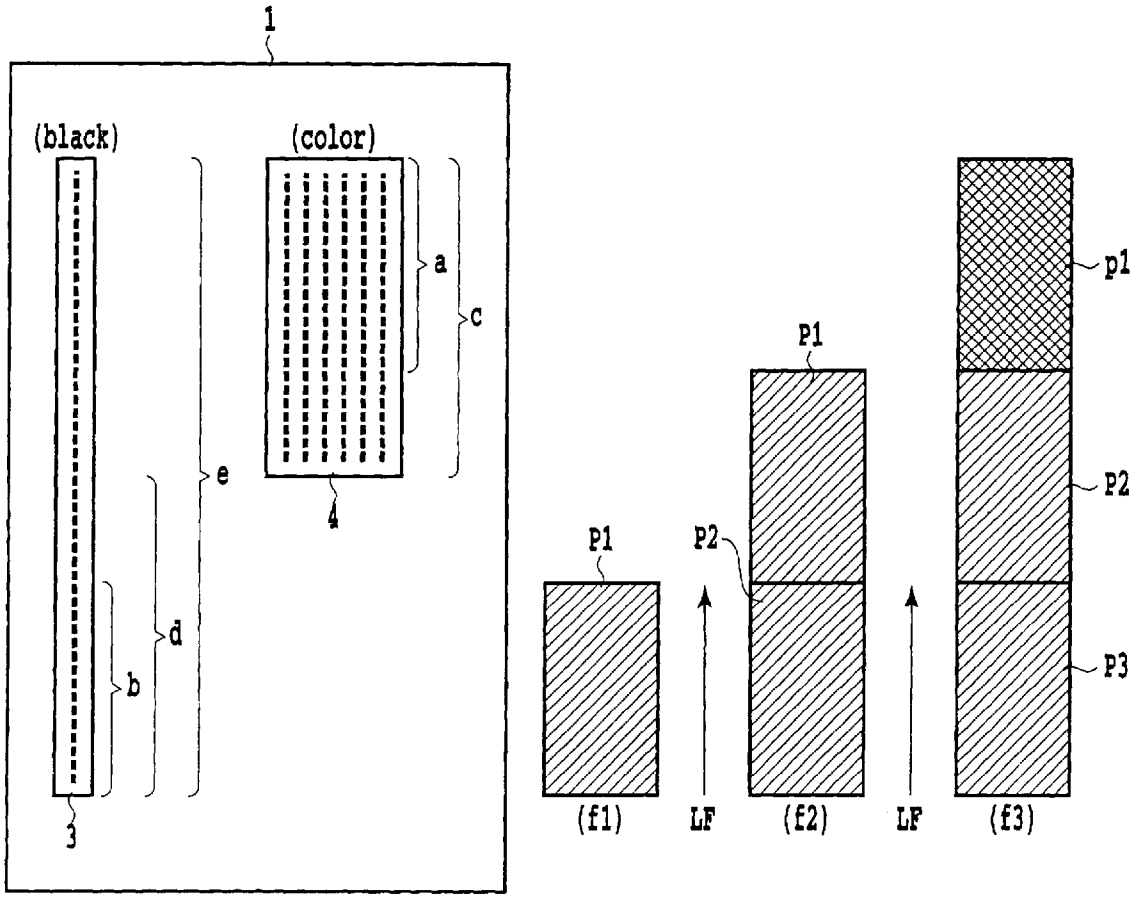
FIG. 5 is a schematic diagram showing a black ink nozzle column and color ink nozzle columns in a print head of a second embodiment.

FIG. 5 is a schematic diagram showing nozzle columns in a print head used in this embodiment. Denoted 1 is a print head, 3 a nozzle column for ejecting a black ink, and 4 nozzle columns for ejecting color inks. The vertically extending, parallel color nozzle columns are each assigned a different color ink and have their nozzles arrayed vertically. The black nozzle column 3, arranged by the side of the color nozzle columns 4, is longer than the color nozzle columns 4 and thus protrudes from them.

The entire nozzles arrayed in the black nozzle column is taken as a nozzle portion e, of which one part is taken as a nozzle portion b and another as a nozzle portion d. The nozzle portion b is about one third of the entire nozzle column length, and the nozzle portion d is about one-half of the entire nozzle column length. The entire nozzles arrayed in each of the color nozzle columns 4 are represented as a nozzle portion c and a part of it as a nozzle portion a.

The nozzle intervals in the black nozzle column 3 are not uniform, with the nozzle interval in the nozzle portion b differing from that of the remaining portion. In other than the nozzle portion b the nozzles are arranged at an interval of 600 dpi or approximately 42.333 micrometers. In the nozzle portion b, the nozzles are arranged at such an interval that the nozzle portion b is 15 micrometers longer than it would be if they were arranged at the interval of 600 dpi. In this embodiment, the black nozzle column has a total of 600 nozzles, the nozzle portion b has 200 nozzles, and the nozzle portion d has 300 nozzles. Thus, the nozzle portion b has its nozzles arranged at an interval of about 42.408 micrometers. The remaining portion has a nozzle interval of 42.333 micrometers.

The color nozzle columns 4 have their nozzles arranged at equal intervals, which are 600 dpi the same as that used in the black nozzle column 3 other than the nozzle portion b. Each of the color ink nozzle columns has 300 nozzles in total, with 200 nozzles in the nozzle portion a and 300 nozzles in the nozzle portion c. That is, the nozzle portion b and the nozzle portion a have the same number of nozzles, and the nozzle portion d and the nozzle portion c are also equal in their nozzle number.

A color printing is performed as follows by using the nozzle portion b of the black nozzle column 3 and the nozzle portion a of the color nozzle columns 4. In the figure, (f1)-p1 represents a position or area, relative to the print head, of an image formed by the black ink ejected from the nozzle portion b in a first printing scan. Then, the print medium is fed a predetermined distance in a direction indicated by LF, moving the printed image p1 to a position of (f2)-p1. After this, a second printing scan prints an image at a position of (f2)-p2 with the black ink ejected from the nozzle portion b. This is followed by another line feed over a distance and in a direction as indicated by LF. Then, a subsequent printing scan prints an image at a position of (f3)-p1 with color inks ejected from the nozzle portion a and at the same time prints an image at a position of (f3)-p3 with the black ink ejected from the nozzle portion b. Now, an image formation in the area of (f3)-p1 using the black ink and color inks is completed.

With the black nozzle column divided into three parts as described above, every image area is given one idle scan between a preceding black ink printing and a subsequent color ink printing during which it is not printed at all. This makes a time interval, from the black ink landing on the image area to the color inks landing on it, longer than when the black nozzle column is divided in two. Thus, by the time the color inks land on that image area on the print medium, the black ink that landed earlier on the image area is well on its way in the process of penetrating into and fixing in the print medium, advantageously preventing intercolor bleeding and spreading of the black ink and color inks. Further, in a bidirectional printing, this arrangement ensures that, for any image area on the print medium, the scan direction of black ink printing and the scan direction of color ink printing are the same and the time interval from a black ink adhering to the image area to color inks adhering to it is constant. This in turn makes image impairments due to printing interval variations less likely to occur.

Since the line feed distance is equal to the length of an array of 200 nozzles at 600 dpi, the image area printed with a black ink is 15 micrometers longer than the line feed distance. Therefore, as in Embodiment 1, the adjoining image areas printed by separate printing scans overlap each other at their boundaries, thus preventing a phenomenon in which boundary portions are printed lighter than other portions.

Further, during a black-only printing, all the nozzles of the black nozzle column 3 or nozzle portion e are used for image forming. In this case, the line feed distance is equal to a length of an array of 600 nozzles at 600 dpi and the width of each image area is 15 micrometers longer than the line feed distance. Therefore, the adjoining image areas printed by separate printing scans overlap each other at their boundary portions, thus preventing the phenomenon of the light boundary portions.

When a color image is to be printed in a print mode which gives priority to a speed over an image quality, the nozzle portion d of the black nozzle column and the nozzle portion c of the color nozzle columns are used in the similar manner to that of Embodiment 1. In this case, the line feed distance is equal to a length of an array of 300 nozzles at 600 dpi and the width of each black image area is 15 micrometers longer than the line feed distance. Therefore, as in the preceding case, the adjoining black image areas printed by separate printing scans overlap each other at their boundary portions, eliminating a phenomenon of the boundary portions appearing lighter.

That is, in any of the color printing, the black-only printing and the high-speed color print mode, the amount of overlap at the boundary portions remains the same, assuring a good printed result at all times.

(Embodiment 3)

In this embodiment, nozzle columns of different color inks are longitudinally arranged in line, rather than being arranged parallel side by side as in Embodiment 1 and 2.

Figure 6:
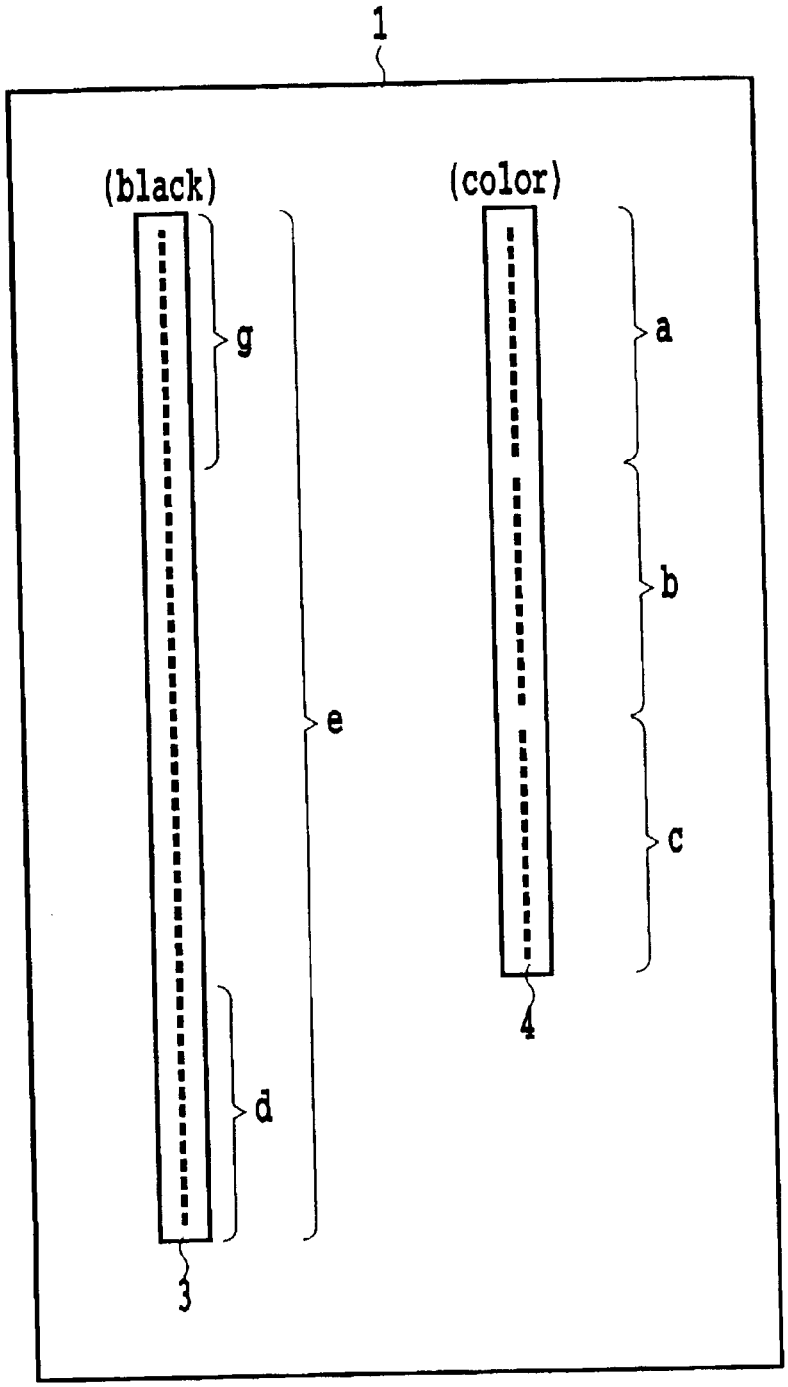
FIG. 6 is a schematic diagram showing a black ink nozzle column and color ink nozzle columns in a print head of a third embodiment.

FIG. 6 is a schematic diagram showing nozzle columns in a print head of this embodiment.

Reference numeral 1 represents a print head, 3 a black ink nozzle column and 4 a color ink nozzle column. The entire black ink nozzle column is denoted a nozzle portion e, of which a part is denoted a nozzle portion d and another part a nozzle portion g. The color ink nozzle column 4 is divided into three parts, a nozzle portion a for ejecting a yellow ink, a nozzle portion b for ejecting a magenta ink, and a nozzle portion c for ejecting a cyan ink. These nozzle portions a, b, c are equal in length. The black ink and color inks are both printed at a resolution of 600 dpi.

The black nozzle column 3 other than the nozzle portion d has nozzles arranged at 600 dpi, i.e., at an interval of about 42.333 micrometers. The nozzles in the nozzle portion d are arranged such that the nozzle portion d is 15 micrometers longer than when its nozzles are arranged at the interval of 600 dpi. That is, they are spaced apart from each other by about 42.483 micrometers. In this embodiment, the black nozzle column has 550 nozzles and the nozzle portion d has 100 nozzles.

The color ink nozzle column 4 has its nozzles arranged at 600 dpi, i.e., at the same interval as that of the black nozzle column other than the nozzle portion d. The color nozzle column has a total of 300 nozzles, 100 nozzles each for the nozzle portion a, b and c.

In the black-only printing, all the nozzles in the black nozzle column or nozzle portion e are used. The line feed distance is equal to a length of an array of 550 nozzles at 600 dpi, i.e., approximately 23.283 millimeters. Since the nozzle portion d has a wider nozzle interval, the width of each image area printed by a single printing scan is 15 micrometers longer than the line feed distance. Thus, the adjoining image areas printed by separate printing scans overlap each other at their boundary portions, thereby avoiding a problem of boundary portions appearing lighter.

In the color printing, the line feed distance is equal to a length of 100 nozzles at 600 dpi, or 4.233 millimeters. As for the black nozzle column, the nozzle portion d is used, so the width of each black image area is 15 micrometers longer than the line feed distance. Further, the black nozzle column is longer than the color nozzle column and the printing is done in the similar manner to that of Embodiment 2. That is, when the printing scan is started, a black ink printing is first performed, followed by the line feed of a predetermined distance. Then, the printing scan and the line feed are subsequently repeated. When the image area that was printed with a black ink in the first scan reaches the color nozzle column, it is printed with color inks in the order of cyan, magenta and yellow ink. In this case also, the adjoining image areas printed by separate scans overlap each other at their boundaries, avoiding the problem of boundary portions being printed lighter than other portions.

It is apparent that, in this embodiment, too, the black-only printing and the color printing both have the same amount of overlap at the boundaries.

In Embodiment 1 to Embodiment 3, in that nozzle portion of the black nozzle column which is used when forming an image with color inks and a black ink, the nozzle intervals are equal or uniform. The present invention is not limited to this configuration. The only requirement is that the width in the line feed direction of each black image area printed by a single printing scan be a predetermined amount longer than the line feed distance that conforms to a resolution of print data. Thus, the nozzle intervals in that nozzle portion of the black nozzle column which is used to form an image using color inks and a black ink need not be uniform. For example, only one-half of that nozzle portion of the black nozzle column which is used to form an image using color inks and a black ink may be provided with a comparatively longer nozzle interval. However, when each image area is to be printed in a few scans by performing a shorter line feed (as in a printing method which divides print data for each image area into two and halves the line feed distance to complete a black image in any image area with two printing scans and one line feed), the black nozzle column's nozzle portion of interest is advantageously set with a uniform nozzle interval.

Further, in Embodiment 1 to Embodiment 3, only the black nozzle column has its nozzle portion to be used change in length according to the printing condition. The nozzle interval in the black nozzle column is also varied from one nozzle portion to another. The present invention is not limited to this configuration. Changing the nozzle portion to be used according to the printing condition may also be applied to other nozzle columns, such as color nozzle columns. Where a problem of image impairments such as described earlier occurs, a nozzle interval in a relatively short nozzle portion or an average nozzle interval may be set longer than those of other nozzle portions according to how the nozzle portion is used. However, because a black ink is usually used for character image printing, the black ink often has a composition with a high surface tension for the purpose of making edges of character images clear. Therefore, the black ink will easily cause the aforementioned image impairment problem and this invention is considered to be most effectively applied to the black ink.

In these embodiments, the conditions for selecting the nozzle portion to be used have been described in two example cases, one in which an image is formed with only a black ink and one in which an image is formed using both color inks and a black ink. Further, in Embodiment 2 an example of changing control on such items as a range of nozzle portion to be used and a line feed distance has been explained for cases where a priority is given to a printing speed and where an image quality is given priority. However, the present invention is not limited to this configuration and can also be effectively applied to a case where the length of a nozzle portion to be used for printing is changed for other reasons.

Further, in Embodiment 1 to Embodiment 3, the black nozzle column is so set that, in whatever printing condition, the width of each image area printed by a single printing scan is 15 micrometers longer than the line feed distance. The present invention is not limited to this value but may employ any appropriate length. It is noted, however, that too small a difference between the image area width and the line feed distance may result in a failure to eliminate the image impairment problem or produce too little effect in alleviating the problem. Conversely, too large a difference will result in the overlap of adjoining image areas printed by a plurality of printing scans becoming too large, causing another image problem in which boundary portions may look darker depending on an image produced. A setting of the above difference effective in avoiding the image problem varies depending on the composition and amount of ink ejected from the nozzle column and also has some allowable range. Therefore, if a difference setting for a case where a relatively long nozzle portion of the nozzle column is used and a difference setting for a case where a relatively short nozzle portion is used fall in the allowable range, they can produce an effect of avoiding or alleviating the image problem. A desirable setting also varies depending on the print medium. Considering the fact that in practice a value which is desirable on average for a plurality of print media is set, it is advantageous to set the nozzle intervals in such a manner that the setting for the relatively long nozzle portion and the setting for the relatively short nozzle portion will be equal.

The present invention achieves distinct effect when applied to a printing head or a printing apparatus-which has means for generating thermal energy such as electrothermal transducers or laser light, and which causes changes in ink by the thermal energy so as to eject ink. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces sudden temperature rise that exceeds the nucleate boiling so as to cause the film boiling on heating portions of the printing head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a printing head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the printing head, the present invention can achieve printing positively and effectively.

In addition, the present invention can be applied to various serial type printing heads: a printing head fixed to the main assembly of a printing apparatus; a conveniently replaceable chip type printing head which, when loaded on the main assembly of a printing apparatus, is electrically connected to the main assembly, and is supplied with ink therefrom; and a cartridge type printing head integrally including an ink reservoir.

It is further preferable to add a recovery system, or a preliminary auxiliary system for a printing head as a constituent of the printing apparatus because they serve to make the effect of the present invention more reliable. Examples of the recovery system are a capping means and a cleaning means for the printing head, and a pressure or suction means for the printing head. Examples of the preliminary auxiliary system are a preliminary heating means utilizing electrothermal transducers or a combination of other heater elements and the electrothermal transducers, and a means for carrying out preliminary ejection of ink independently of the ejection for printing. These systems are effective for reliable printing.

The number and type of printing heads to be mounted on a printing apparatus can be also changed. For example, only one printing head corresponding to a single color ink, or a plurality of printing heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet printing apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

As described above, with this invention, by arranging the nozzles in a nozzle column such that, in only that portion of the nozzle column used in whatever printing condition, such as color printing and black-only printing, its nozzles have a wider interval than those of other nozzle portions, the width of each image area printed by a single printing scan can be made a predetermined amount longer than the line feed distance at all times. Thus, since adjoining image areas printed by separate printing scans overlap each other at their boundary portions by a predetermined amount in whatever printing condition, a good printed result can always be produced even in an ink jet printing apparatus in which the range of use of the nozzle column varies depending on the printing condition.

When printing is performed in either a color print mode or a black-only print mode, that portion of the black ink nozzle column which has the wider nozzle interval is used for the color print mode and the entire black nozzle column is used for the black-only print mode. This assures a good printed result at all times whether in the color printing or in the black-only printing. Further, the black-only printing can enhance the printing speed because the width of each image area printed by one printing scan is larger in the black-only printing than in the color printing.

The nozzle portion with an increased nozzle interval is so arranged that the length of the nozzle portion in the nozzle array direction is about 15 micrometers longer than when it has the same number of nozzles arranged at a normal interval. This arrangement can keep the overlap of the adjoining image areas at about 15 micrometers at all times, preventing possible image quality degradations due to excessive overlaps.

Further, since the wide-nozzle-interval portion of the black ink nozzle column is disposed in front of the color ink nozzle columns with respect to the line feed direction, the image area printed by the wide-nozzle-interval portion of the black ink nozzle column is not printed with color inks in the same printing scan but will be applied the color inks in the next or subsequent printing scans. Thus, the black ink can penetrate well into the print medium before the color inks are applied to the same image area, thus preventing a phenomenon of intercolor bleeding of the black ink and the color inks.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet print head having a plurality of nozzle columns, each of which comprises a plurality of nozzles arrayed in a predetermined direction, said plurality of nozzle columns being adapted to eject ink, wherein said plurality of nozzle columns includes a first nozzle column that has a long nozzle column portion whose nozzle-to-nozzle interval is greater than that in another portion of said first nozzle column, and a second nozzle column that does not have a long nozzle column portion.

2. An ink jet print head according to claim 1, wherein said long nozzle column portion comprises a plurality of nozzles arrayed in a predetermined direction from one end of said first nozzle column.

3. An ink jet print head according to claim 1, wherein said long nozzle column portion is 15 micrometers longer in a direction of nozzle array than said other nozzle column portion in said first nozzle column, said other nozzle column portion having the same number of nozzles as said long nozzle column portion.

4. An ink jet printing apparatus comprising:

an ink jet print head having a plurality of nozzle columns, each of which comprises a plurality of nozzles arrayed in a predetermined direction, said plurality of nozzle columns being adapted to eject ink;

scanning means for effecting relative scanning movement between said ink jet print head and a print medium a plurality of times in a direction different from the predetermined direction, each of the plurality of scans being performed to eject ink onto a predetermined image area on the print medium; and feeding means for effecting relative feeding movement of the print medium and said ink jet print head by a predetermined distance in a direction different from the scan direction of said ink jet print head, between each of the plurality of scans, wherein said plurality of nozzle columns includes a first nozzle column that has a long nozzle column portion whose nozzle-to-nozzle interval is greater than that in another portion of said first nozzle column, and a second nozzle column that does not have a long nozzle column portion, and wherein a width in the feed direction of each image area printed by a single scan of said first nozzle column is greater than the predetermined distance that the print medium is fed by said feeding means.

5. An ink jet printing apparatus according to claim 4, wherein said apparatus performs printing in a plurality of print modes, and said long nozzle column portion of said ink jet print head may be used in any of the print modes.

6. An ink jet printing apparatus according to claim 4, wherein some of said nozzle columns are for ejecting color inks and one of said nozzle columns is for ejecting a black ink, and said long nozzle column portion is provided only in said black ink ejecting nozzle column, and wherein, of areas printed in one scan by said ink jet print head in a print mode using both said black ink ejecting nozzle column and said color ink ejecting nozzle columns, an area printed with the black ink is longer in the feed direction than an area printed with the color inks.

7. An ink jet printing apparatus according to claim 6, wherein, in a print mode using only said black ink ejecting nozzle column, all the nozzles making up said black ink ejecting nozzle column are used for printing and, in a print mode using both said black ink ejecting nozzle column and said color ink ejecting nozzle columns, only a number of nozzles of said black ink ejecting nozzle column which is equal to the number of nozzles making up each of said color ink ejecting nozzle columns is used for printing, the nozzles of said black ink ejecting nozzle column which are used being the nozzles of said long nozzle column portion.

8. An ink jet printing apparatus according to claim 6, wherein said color ink ejecting nozzle columns and said black ink ejecting nozzle column are arranged parallel to each other in the scan direction of said ink jet print head, and said color ink ejecting nozzle columns are disposed in the vicinity of a portion of said black ink ejecting nozzle column other than said long nozzle column portion, and wherein, in the print mode using both said black ink ejecting nozzle column and said color ink ejecting nozzle columns, the areas printed by said color ink ejecting nozzle columns and said long nozzle column portion in the same scan are different.

9. An ink jet printing apparatus according to claim 8, wherein said color ink ejecting nozzle columns are disposed behind said long nozzle column portion in the feed direction, and wherein, in the print mode using both said black ink ejecting nozzle column and said color ink ejecting nozzle columns, the area printed by said long nozzle column portion is printed by said color ink ejecting nozzle columns in the next or subsequent scan.

10. An ink jet printing apparatus according to claim 4, wherein said ink jet print head has one heating element for each nozzle, and each of said heating elements generates a bubble in the ink by means of thermal energy so as to eject an ink droplet from the respective nozzle by bubble-generated pressure.

11. An ink jet printing apparatus comprising:

a plurality of ink jet print heads, each of which has a plurality of nozzles arrayed in a predetermined direction to form a nozzle column, said nozzle columns being adapted to eject ink;

scanning means for effecting relative scanning movement between said plurality of ink jet print heads and a print medium a plurality of times in a direction different from the predetermined direction, each of the plurality of scans being performed to eject ink onto a predetermined image area on the print medium; and feeding means for effecting relative feeding of the print medium and said plurality of ink jet print heads by a predetermined distance in a direction different from the scan direction of said plurality of ink jet print heads, between each of the plurality of scans, wherein the nozzle column of a first ink jet print head has a long nozzle column portion whose nozzle-to-nozzle interval is greater than that in another portion of said nozzle column, and the nozzle column of a second ink jet print head does not have a long nozzle column portion, and wherein a width in the feed direction of each image area printed by a single scan of said first ink jet print head is greater than the predetermined distance that the print medium is fed by said feeding means.

* * * * *